US011054204B2

(12) United States Patent
Curry

(10) Patent No.: US 11,054,204 B2
(45) Date of Patent: Jul. 6, 2021

(54) TRIGGER RETURN SPRING MECHANISM

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/060,327

(22) Filed: Oct. 1, 2020

(65) Prior Publication Data

US 2021/0102771 A1 Apr. 8, 2021

Related U.S. Application Data

(60) Provisional application No. 62/910,516, filed on Oct. 4, 2019.

(51) Int. Cl.
*F41A 19/10* (2006.01)
*F41A 19/12* (2006.01)

(52) U.S. Cl.
CPC ..... *F41A 19/10* (2013.01); *F41A 19/12* (2013.01)

(58) Field of Classification Search
CPC ..... F41A 19/10; F41A 19/12
See application file for complete search history.

(56) References Cited

U.S. PATENT DOCUMENTS 2,046,996 A * 7/1936 Berdon ..... F41A 19/10 42/69.01
2,846,925 A 8/1958 Norman
3,029,708 A 4/1962 Marchisio
3,152,418 A * 10/1964 Charron ..... F41A 19/48 42/69.03
4,123,963 A * 11/1978 Junker ..... F41A 3/26 89/152
4,213,263 A * 7/1980 Brouthers ..... F41A 19/11 42/59
4,391,057 A * 7/1983 Bornancini ..... F41A 19/53 42/65
4,577,430 A * 3/1986 Ruger ..... F41A 19/10 42/69.01
4,819,358 A * 4/1989 Eder ..... F41A 19/16 42/59
6,347,474 B1 * 2/2002 Wolff, Jr. ..... F41A 19/10 42/69.01
7,690,144 B2 4/2010 Fagundes de Campos
(Continued)

*Primary Examiner* — Joshua T Semick
(74) *Attorney, Agent, or Firm* — John A. Chionchio, Esq.; Ballard Spahr LLP

(57) ABSTRACT

A trigger return spring assembly mountable on a frame of a firearm includes a trigger mounted on the frame pivoting about a first axis of rotation. A trigger bar attached to the trigger pivots relative to the trigger about a second axis of rotation fixed on the trigger. A bore extends through the trigger along a third axis oriented transversely to and positioned between the first and second axes of rotation. A plunger extends through the bore and is movable along the third axis. A first end of the plunger is attached to the trigger bar and a second end has a retaining surface oriented transversely to the third axis. A shoulder is positioned within the bore proximate to the trigger bar. A compression spring captured within the bore, between the shoulder and the retaining surface, exerts a force pushing the retaining surface away from the shoulder.

14 Claims, 2 Drawing Sheets

(56) References Cited

U.S. PATENT DOCUMENTS

| | | | | |
|---|---|---|---|---|
| 8,863,425 | B2 | 10/2014 | Lee | |
| 8,935,872 | B2 | 1/2015 | Zukowski | |
| 9,121,654 | B2 | 9/2015 | Arnedo Vera et al. | |
| 9,316,455 | B2 * | 4/2016 | Hirschheiter | F41A 19/32 |
| 9,347,725 | B2 * | 5/2016 | McAlister | F41A 19/10 |
| 9,625,227 | B2 | 4/2017 | Lee | |
| 9,739,557 | B2 | 8/2017 | Lee | |
| 10,030,927 | B1 | 7/2018 | Theiss | |
| 10,422,602 | B2 | 9/2019 | Theiss | |

* cited by examiner

TRIGGER RETURN SPRING MECHANISM

CROSS REFERENCE TO RELATED APPLICATION

This application is based upon and claims benefit of priority to U.S. Provisional Application No. 62/910,516, filed Oct. 4, 2019, the application being hereby incorporated by reference.

FIELD OF THE INVENTION

The invention concerns trigger and trigger bar assemblies used with firearms.

BACKGROUND

Trigger return springs of the extension or torsion type, used in semiautomatic pistols, are subject to relatively high stress reversals (alternating compression and tension stress). As the paramount design parameter of such a spring is its stiffness, the design of the spring cannot generally take the spring's fatigue life into account. Extension and torsion springs may thus suffer from premature fatigue failure. It would be advantageous to use a compression spring to mitigate fatigue failure and increase the fatigue life of trigger return springs.

SUMMARY

This invention concerns a trigger return spring assembly for a firearm. In this example embodiment, the trigger return spring assembly comprises a trigger, a trigger bar, a bore, a shoulder, a plunger and a spring. The trigger is mountable on the frame for pivoting motion about a first axis of rotation fixed on the frame. The trigger bar is attached to the trigger and is pivotable relatively thereto about a second axis of rotation fixed on the trigger. The bore extends through the trigger along a third axis oriented transversely to and positioned between the first and second axes of rotation. The shoulder is positioned within the bore proximate to the trigger bar. The plunger extends through the bore and is movable along the third axis. A first end of the plunger is attached to the trigger bar, and a second end of the plunger comprises a retaining surface oriented transversely to the third axis. The compression spring is captured within the bore between the shoulder and the retaining surface. The compression spring exerts a force pushing the retaining surface away from the shoulder.

In an example, the first end of the plunger terminates in a first head and the second end terminates in a second head. In a particular example, the retaining surface is located on the second head facing the spring. In another particular example, the second head is rotatable about a fourth axis transverse to the third axis. In a particular example, the assembly further comprise a yoke mounted on the trigger bar. In this example, the first head pivotally engages the yoke.

As an example, the assembly further comprises a first pin which attaches the trigger bar to the trigger. In an example, the assembly further comprises a second pin which attaches the trigger to the frame.

This invention also concerns a firearm. In this example embodiment, the firearm comprises a frame. A trigger return spring assembly comprises a trigger, a trigger bar, a bore, a shoulder, a plunger, and a compression spring. The trigger is mounted on the frame for pivoting motion about a first axis of rotation about the frame. The trigger bar is attached to the trigger pivotable relatively thereto about a second axis of rotation fixed on the trigger. The bore extends through the trigger along a third axis oriented transversely to and positioned between the first and second axes of rotation. The shoulder is positioned within the bore proximate to the trigger bar. The plunger extends through the bore and is movable along the third axis. A first end of the plunger is attached to the trigger bar, and a second end of the plunger comprise a retaining surface oriented transversely to the third axis. The compression spring is captured within the bore between the shoulder and the retaining surface. The compression spring exerts a force which pushes the retaining surfaced away from the shoulder.

In an example, the first end of the plunger terminates in a first head and the second end terminates in a second head. In a particular example, the retaining surface is located on the second head facing the spring. In another particular example, the second head is rotatable about a fourth axis transverse to the third axis. In a particular example, the assembly further comprise a yoke mounted on the trigger bar. In this example, the first head pivotally engages the yoke.

As an example, the assembly further comprises a first pin which attaches the trigger bar to the trigger. In an example, the assembly further comprises a second pin which attaches the trigger to the frame.

DETAILED DESCRIPTION

Figure 1:
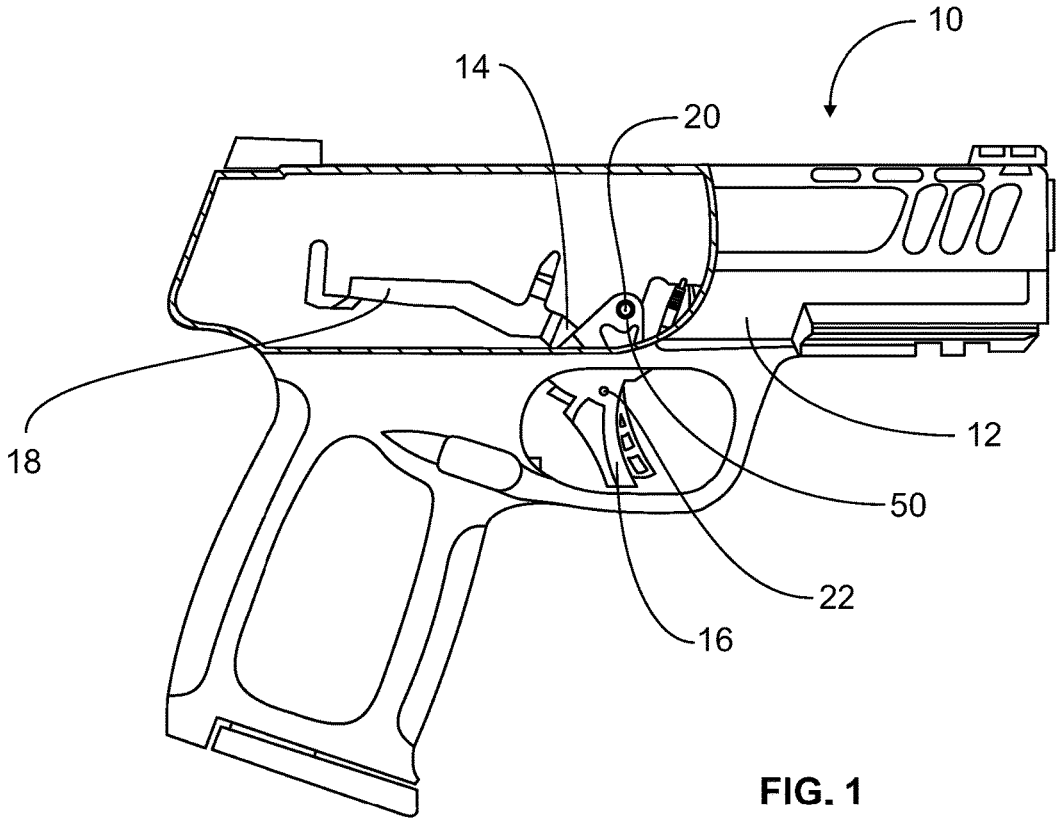
FIG. 1 is a side view of an example firearm, showing a trigger return spring mechanism according to the invention.

FIG. 1 shows an example firearm 10 according to this invention. The firearm 10, a pistol in this example, comprises a frame 12. A trigger return spring mechanism 14 is mountable on the frame 12 of the firearm 10.

Figure 2:
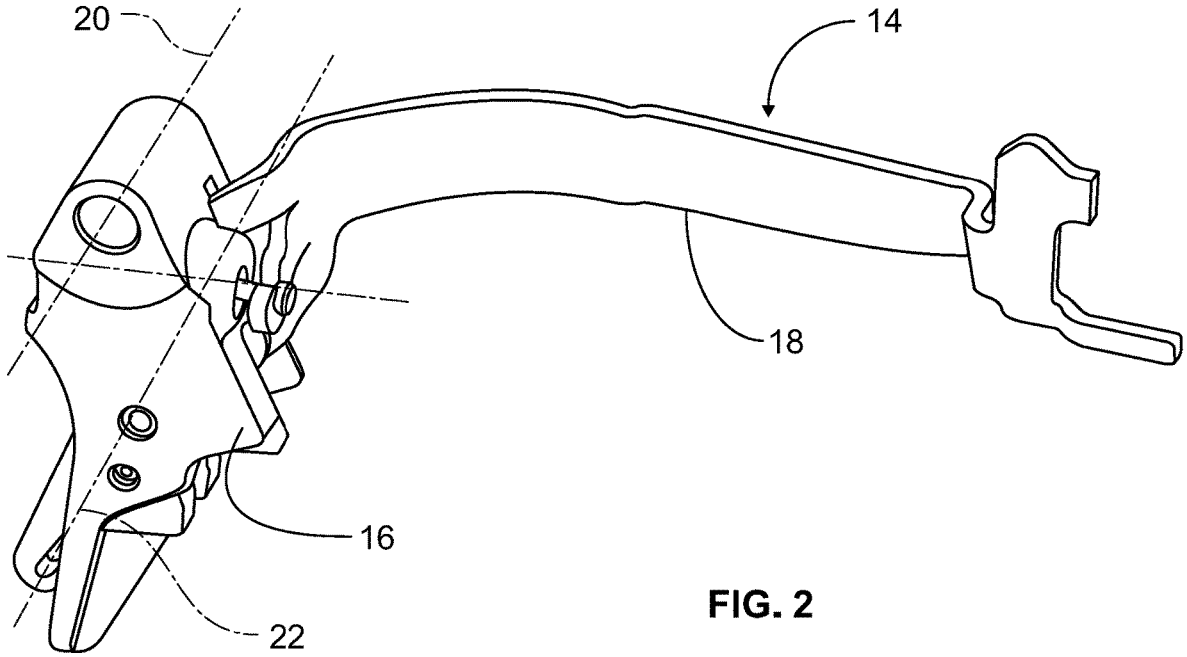
FIG. 2 is an isometric view of the example trigger return spring mechanism according to the invention.

As shown in FIG. 2, the example trigger return spring mechanism 14 comprises a trigger 16 and a trigger bar 18. The trigger 16 is mounted on the frame 12 (see FIG. 1) for pivoting motion about a first axis of rotation 20 fixed to the frame 12 (see FIG. 1). The trigger bar 18 is attached to the trigger 16 and is pivotable relatively the trigger 16 about a second axis of rotation 22 fixed on the trigger 16.

Figure 3:
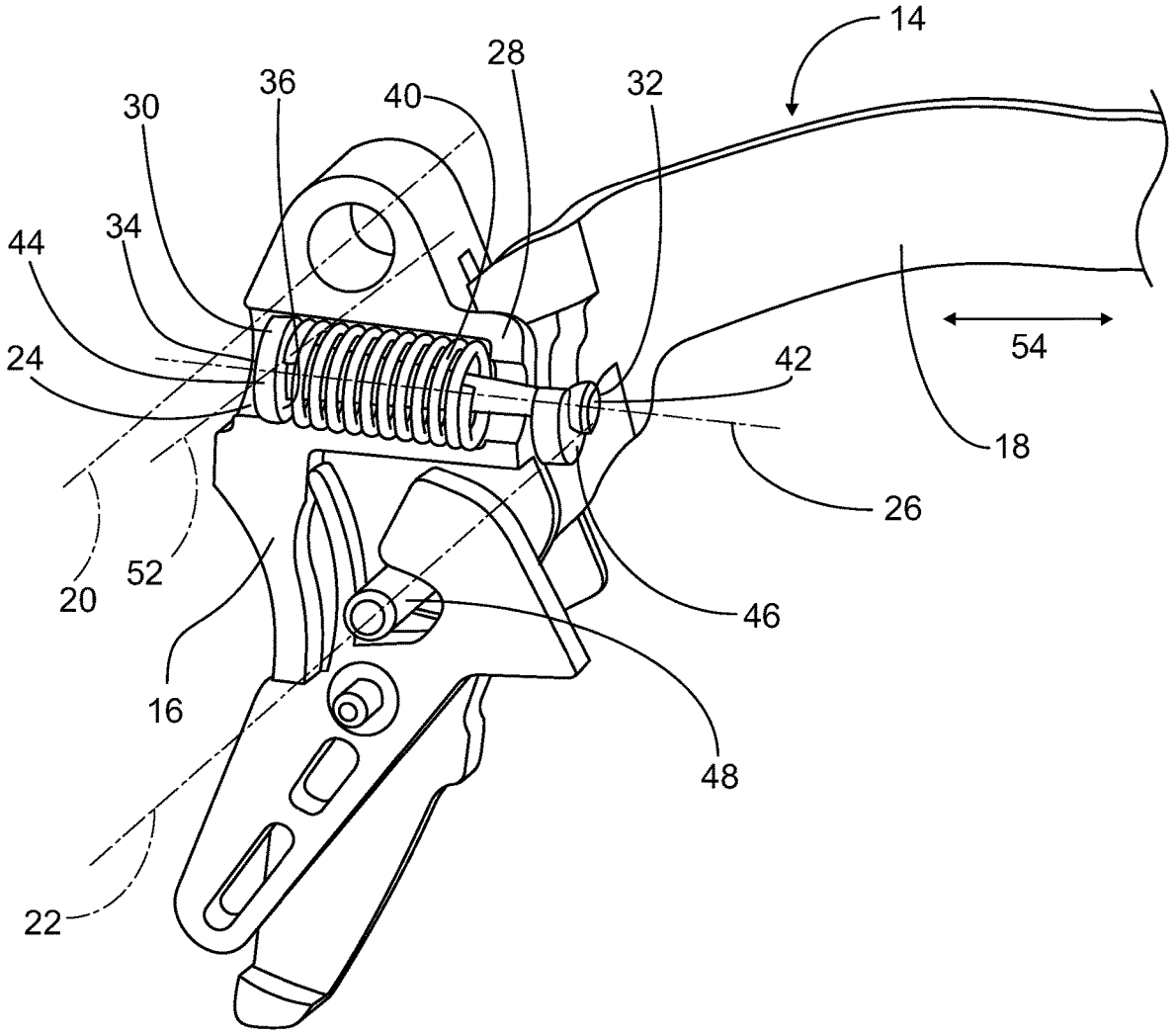
FIG. 3 is a partial sectional isometric view of the example of a portion of the trigger return spring mechanism according to the invention.

As shown in FIG. 3, a bore 24 extends through the trigger 16 along a third axis 26 oriented transversely to and positioned between the first and second axes of rotation 20 and 22. A shoulder 28 is positioned within the bore 24 proximate to the trigger bar 18. A plunger 30 extends through the bore 24 and is movable along the third axis 26. A first end 32 of the plunger 30 is attached to the trigger bar 18. A second end 34 of the plunger 30 comprises a retaining surface 36 oriented transversely to the third axis 26. A compression spring 40 is captured within the bore 24 between the shoulder 28 and the retaining surface 36. The retaining surface 36 faces the spring 40. The compression spring 40 exerts a force which pushes the retaining surface 36 away from the shoulder 28.

Also shown in FIG. 3, the first end 32 of plunder 30 may terminate in a first head 42, and the second end 34 may terminate in a second head 44. To accommodate an offset of the first head 42 from the third axis 26 due to the rotation of trigger 16 about the first axis 20, the second head 44 is rotatable about a fourth axis 52. The fourth axis 52 is transverse to the third axis 26. The retaining surface 36 is located on the second head 44 facing the spring 40. The second head 44 is advantageously sized to move along the third axis 26, rotate about a fourth axis 52, and retain the spring 40.

The assembly 10 may further comprise a yoke 46 mounted on the trigger bar 18. The first head 42 pivotally engages the yoke 46. The pivoting of the first head 42 within the yoke 46 accommodates the offset of the first head 42 from the third axis 26 due to the rotation of the trigger 16 about the first axis 20.

The assembly 10 may also further comprise a first pin 48 which attaches the trigger bar 18 to the trigger 16, advantageously facilitating the pivoting of trigger bar 18 relative to the trigger 16 about the second axis of rotation 22. As shown in FIG. 1, the assembly 10 may further comprise a second pin 50 which attaches the trigger 16 to the frame 12, advantageously facilitating the pivoting of the trigger 16 about the first axis of rotation 20 (see also FIG. 2).

In use force is applied to trigger 16 rotating it about the axis of rotation 20 in a direction of trigger bar 18. As trigger 16 rotates from the "ready" position the trigger bar 18, pivotally connected to trigger 16 by the first pin 48, moves in a direction 54 away from the trigger 16. As the trigger bar 18 moves the yoke 46, first head 42, and plunger 30 also move further compressing spring 40 between the retaining surface 36 and shoulder 28. When the force is released from trigger 16 the compressed spring 40 exerts a force pushing the retaining surface 36 away from the shoulder 28 returning the trigger 16 to the "ready" position.

The firearm 10 with the trigger return spring mechanism 14 described herein is expected to mitigate fatigue failure and increase the fatigue life of trigger return springs.

What is claimed is:

1. A trigger return spring assembly for a firearm comprising a frame, said trigger return spring assembly comprising:

a trigger mountable on said frame for pivoting motion about a first axis of rotation fixed on said frame;

a trigger bar attached to said trigger and pivotable relatively thereto about a second axis of rotation fixed on said trigger;

a bore extending through said trigger along a third axis oriented transversely to and positioned between said first and second axes of rotation;

a shoulder positioned within said bore proximate to said trigger bar;

a plunger extending through said bore and movable along said third axis, a first end of said plunger being attached to said trigger bar, a second end of said plunger comprising a retaining surface oriented transversely to said third axis; and a compression spring captured within said bore between said shoulder and said retaining surface and exerting a force pushing said retaining surface away from said shoulder.

2. The trigger return spring assembly according to claim 1, wherein said first end of said plunger terminates in a first head, and said second end of said plunger terminates in a second head.

3. The trigger return spring assembly according to claim 2, wherein said retaining surface is located on said second head facing said spring.

4. The trigger return spring assembly according to claim 2, wherein said second head is rotatable about a fourth axis transverse to said third axis.

5. The trigger return spring assembly according to claim 2, further comprising a yoke mounted on said trigger bar, said first head pivotally engaging said yoke.

6. The trigger return spring assembly according to claim 1, further comprising a first pin attaching said trigger bar to said trigger.

7. The trigger return spring assembly according to claim 1, further comprising a second pin attaching said trigger to said frame.

8. A firearm, said firearm comprising:

a frame;

a trigger return spring assembly comprising:

a trigger mounted on said frame for pivoting motion about a first axis of rotation fixed on said frame;

a trigger bar attached to said trigger and pivotable relatively thereto about a second axis of rotation fixed on said trigger;

a bore extending through said trigger along a third axis oriented transversely to and positioned between said first and second axes of rotation;

a shoulder positioned within said bore proximate to said trigger bar;

a plunger extending through said bore and movable along said third axis, a first end of said plunger being attached to said trigger bar, a second end of said plunger comprising a retaining surface oriented transversely to said third axis; and a compression spring captured within said bore between said shoulder and said retaining surface and exerting a force pushing said retaining surface away from said shoulder.

9. The firearm according to claim 8, wherein said first end of said plunger terminates in a first head, and said second end of said plunger terminates in a second head.

10. The firearm according to claim 9, wherein said retaining surface is located on said second head facing said spring.

11. The firearm according to claim 9, wherein said second head is rotatable about a fourth axis transverse to said third axis.

12. The firearm according to claim 9, further comprising a yoke mounted on said trigger bar, said first head pivotally engaging said yoke.

13. The firearm according to claim 8, further comprising a first pin attaching said trigger bar to said trigger.

14. The firearm according to claim 8, further comprising a second pin attaching said trigger to said frame.

* * * * *